United States Patent [19]

Pramuk et al.

[11] Patent Number: 4,629,239

[45] Date of Patent: Dec. 16, 1986

[54] ARTICLE CARRYING MEANS

[76] Inventors: David A. Pramuk, 912 Hunt Ave., St. Helena, Calif. 94574; James N. O'Shea; Stephen E. O'Shea, both of 520 Corona Rd., Petaluma, Calif. 94952

[21] Appl. No.: 768,129

[22] Filed: Aug. 22, 1985

[51] Int. Cl.[4] ..... A45C 13/26; B65D 7/00

[52] U.S. Cl. ..... 294/153; 294/170

[58] Field of Search ..... 294/153, 154, 152, 156, 294/157, 169, 170, 171, 27.1, 31.1; 24/17 A; 16/110 R

[56] References Cited

U.S. PATENT DOCUMENTS 3,119,160 1/1964 Hoppeler ..... 294/170

FOREIGN PATENT DOCUMENTS 468025 9/1950 Canada ..... 294/153

16085 8/1916 United Kingdom ..... 294/153

*Primary Examiner*—James B. Marbert

*Attorney, Agent, or Firm*—David C. Ripma

[57] ABSTRACT

A carrying means is provided to carry packages or other articles. The carrying means includes a handle provided with a pair of openings through the body of the handle and slots formed in the ends of the handle. A length of cord is threaded through the openings and slots in a manner which, in the preferred embodiment, automatically locks the cord to the handle at the proper length.

8 Claims, 3 Drawing Figures

ARTICLE CARRYING MEANS

BACKGROUND OF THE INVENTION

The invention relates generally to parcel or article carriers of the type which include means for attaching a carrying handle to objects such as parcels.

Considerable additional effort is required to lift and carry bulky or heavy articles or packages which are not equipped with a carrying handle. For this reason, numerous varieties of attachable carrying handles have been devised and patented. Examples of prior art attachable carrying handles are found in U.S. Pat. Nos. 2,457,858; 2,608,328; 1,691,467; 1,020,722 and 736,632.

It would be especially advantageous for a carrying handle to combine the qualities of quick and easy attachment with adjustability, to accommodate packages or articles of various sizes. It would also be advantageous to have an article carrier which can safely be used to lift relatively heavy objects. It would also be advantageous to have an attachable article carrying handle which is inexpensive to manufacture.

SUMMARY OF THE INVENTION

Accordingly, an article carrying means is provided which includes a handle having an elongated body extending between two ends. The handle includes means forming a first slot in one end of the handle and means forming a second slot in the other end of the handle. Means are also provided forming first and second openings extending through the body of the handle. A length of cord is provided which extends through the first and second openings and forms a continuous first loop of cord between the openings. The first loop includes first and second legs which extend, respectively, from the first and second openings and are connected together at the end of the first loop to complete the first loop. The first loop is sufficiently long to encircle and an article to be carried with both the first and second legs of the loop disposed generally parallel to one another around the article. The end of the first loop is secured to the handle for carrying articles encircled by the loop by hooking the end of the first loop lengthwise over the handle, with one leg engaged in one slot and the other leg engaged in the other slot. The preferred embodiment also includes means for adjusting the length of the first loop to accommodate articles of differing girths.

DETAILED DESCRIPTION OF THE PREFERRED EMBODIMENT

Figure 1:
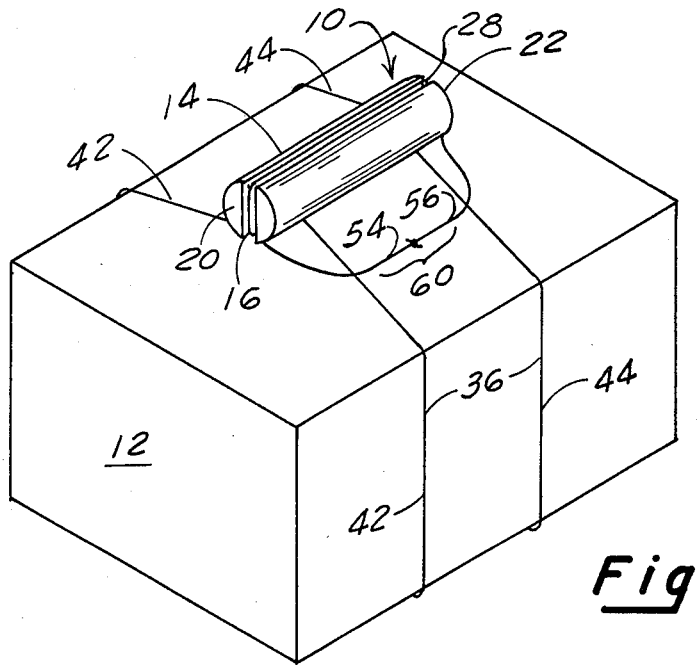
FIG. 1 is a perspective view of the article carrying means of the present invention in place on a package.
Figure 2:
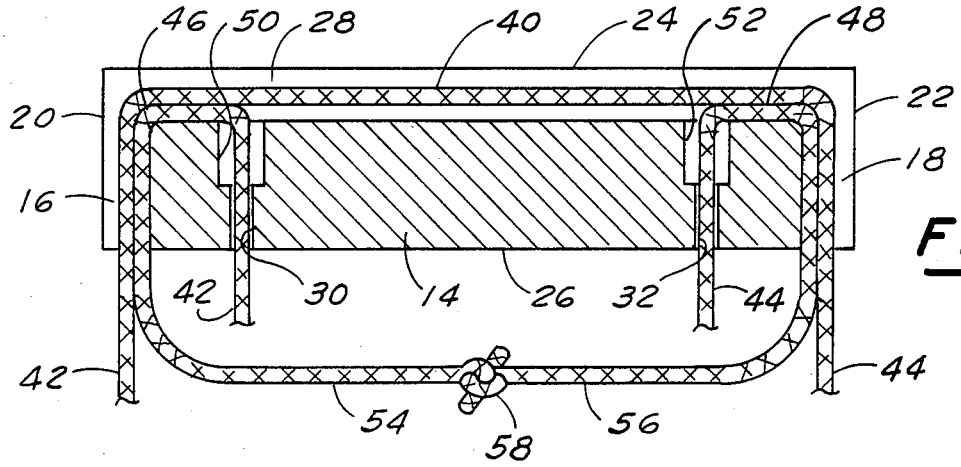
FIG. 2 is a side cross sectional view of the handle of the article carrying means shown in FIG. 1, showing the pattern of the cord within the handle.

Referring to FIG. 1, article carrying means 10, according to the present invention, is shown in place on a package 12, which serves to illustrate a typical article to be carried by article carrier 10. The article carrier includes a handle 14, having an elongated body, in which various slots and openings are formed. The handle should be of a shape which will serve comfortably as a handle. As shown, handle 14 has a long cylindrical shape with a circular cross section, and can be formed from a length of relatively large diameter doweling. For example, a six-inch length of one and one-quarter inch diameter wooden doweling has been found suitable for forming handle 14. Referring to FIGS. 1 and 2, handle 14 includes means forming first and second slots, 16 and 18, respectively, in the two circular ends 20 and 22 of the body of the handle. The slots 16 and 18 are preferably substantially straight and extend accross the body of handle 14 between upper and lower sides thereof, 24 and 26, respectively. Slots 16 and 18 are generally parallel to one another. Means forming a third slot 28 in the handle, extending lengthwise accross upper side 24, is also provided. Third slot 28 communicates with first and second slots 16 and 18 at the upper corners, resulting in a continuous slot extending up one side, accross the upper side of the handle and down the other side.

Handle 14 also includes means forming a pair of openings or holes extending through the body of the handle, between upper side 24 and lower side 26. The openings are designated as first opening 30, proximate to first slot 16 near one end of the handle, and second opening 32, proximate to second slot 18, near the other end of the handle. Openings 30 and 32 are generally aligned with one another, and extend in a direction parallel with the slots 16 and 18. Assuming the body of handle 14 is made of wooden doweling material, openings 30 and 32 can be conveniently drilled. Slots 16 and 18 can be formed by making substantially straight cuts of a selected depth into the circular ends of the wooden doweling by conventional means. Slot 28 can also be made by a conventional cut.

Figure 3:
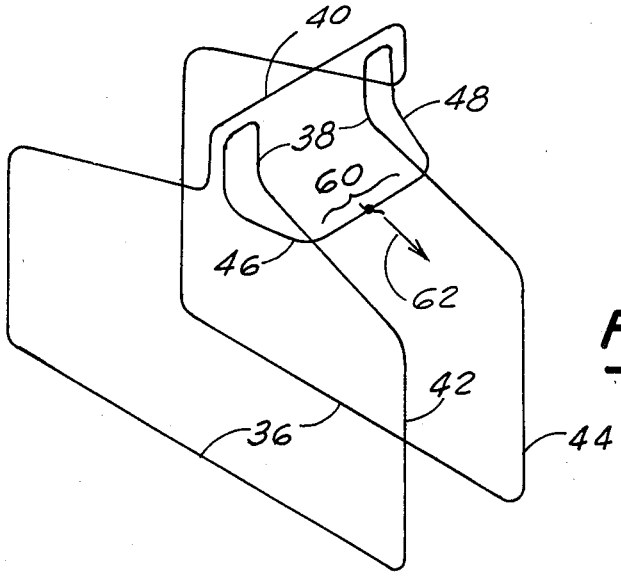
FIG. 3 is a schematic representation of the disposition of the various loops of cord used in the article carrying means of the present invention.

A length of cord, string or rope is threaded through and around handle 14 and the article to be carried in a particular manner described below and shown in the figures. The cording material used can be of any suitable type which is sufficiently strong to lift the articles to be carried, for example, nylon rope. A length of cord 34 extends through openings 30 and 32 on the lower side 26 of handle 14 and forms a continuous first loop 36, extending below the handle. The entire first loop can be seen in FIG. 3, which shows the pattern of the cord 34, with the handle removed. First loop 36, extends from the openings in the handle, at approximately 38, around the package or other article (not shown in FIG. 3) to the end of the first loop, at 40. To better describe the cord pattern, first loop 36 includes first and second legs 42 and 44, which extend, respectively, from first and second openings 30 and 32 in handle 14. Legs 42 and 44 are connected together at the end 40 of the first loop 36 to complete the first loop. It is intended that first loop 36 be a continuous piece of cord, and the term "connected together" is intended to describe where the individual "leg" portions of the loop end and come together. The article carrying means of the present invention would also function if first loop 36 consisted of separate pieces of cord tied or otherwise joined together. To carry a package or other article, first loop 36 must be sufficiently long to encircle an article to be carried, with both the first and second legs of the loop, 42 and 44, disposed generally parallel to one another around the article, as shown in FIG. 1. The end 40 of first loop 36 is then hooked lengthwise over the upper side of handle 14 with one leg engaged in one of the side slots and the other leg engaged in the other side slot. As such, first loop 36, together with handle 14, serve both to encircle and to provide a convenient means of carrying the article.

In order to provide versatility and permit the carrying means to work well on articles of differing sizes and girths, a means of adjusting the length of first loop 36 is provided. Openings 30 and 32 in handle 14 are made large enough, relative to the diameter of cord 34, to allow the cord to freely move through the openings. By free movement through the openings, what is meant is that the cord material can be pulled through the openings in either direction relatively easily. The first and second legs of first loop 36 extend through the openings and emerge on the upper side 24 of handle 14. The portions of first and second legs 42 and 44 which extend through the openings on the upper side of the handle will be referred to herein as the length regulating portions 46 and 48, respectively of first and second legs 42 and 44. By pulling or drawing cord through openings 30 and 32, from the upper side of handle 14, first loop 36 can be shortened to accommodate articles having a smaller girth.

If an article is to be carried by the handle, it is necessary to lock the cord which forms legs 42 and 44 to handle 14 at both ends. Loop end 40 is locked to the handle by hooking it over the handle, through slots 16 and 18. In the preferred embodiment, legs 42 and 44 are locked to handle 14 in a manner which provides adjustability by passing the length regulating portions 46 and 48 of legs 42 and 44 around the sides of handle 14, in the manner shown in FIG. 2. The length regulating portion 46 of first leg 42 extends over the upper side 24 of the handle to first slot 16, and through first slot 16 to the lower side 26 of the handle. The length regulating portion 48 of second leg 44 extends over the upper side 24 of the handle to second slot 18, and through second slot 18 to the lower side of the handle. The end 40 of first loop 36 will overly the length regulating portions of the legs in the slots when an article is being carried, and the pressure exerted by the legs 42 and 44 of the first loop will press against and secure length regulating portions 46 and 48 against slippage in their respective slots. Slots 16 and 18 should be sufficiently large and deep to accommodate two cords in each slot. Preferably, the slots will be approximately one cord diameter in width and slightly more than two cord diameters deep so the cords will stack one upon the other in the slots. With the cords in such a nested relationship within the slots, the weight of an article being carried will exert pressure on the upper, outermost cord which will, in turn, exert pressure against the length regulating cords 46 and 48, locking them in place.

An alternative means of locking legs 42 and 44 to handle 14 (not shown) would be to knot the two ends of the length of cord forming loop 36 on the upper side of the handle, with the cord threaded through openings 30 and 32. First loop 36, extending below the handle, would then be fixed to the handle. On the upper side of the handle, countersunk openings 50 and 52, having a larger diameter than the lower part of openings 30 and 32, permit knots in the cord to be recessed in the handle. Such an arrangement does not provide convenient adjustability, however, and the embodiment described above is preferred.

In use, first loop 36 of the article carrying means of the present invention is extended around the article to be carried, with legs 42 and 44 generally parallel. Loop 36 can be shortened, if necessary, by pulling on the respective ends 54 and 56 of the length regulating portions 46 and 48 of the legs of the loop. Until loop end 40 is hooked over the handle, ends 54 and 56 can be pulled easily through the slots because no pressure is exerted against them by an overlying loop 36. Length adjustment can be facilitated by coupling or otherwise tying ends 54 and 56 together, illustrated by knot 58, to form an auxiliary loop 60. Auxiliary loop 60 extends between slots 16 and 18 on the lower side of handle 14. The auxiliary loop can be grasped and pulled relative to the handle, as indicated generally by arrow 62 in FIG. 3, to shorten the length of first loop 36. When the length adjustment is correct, the end 40 of first loop 36 is hooked over handle 14 lengthwise into slots 16 and 18, as described above. When an article is lifted by the handle, the overlying first loop in the slots exerts substantial pressure against the length regulating portions of the cord, locking them in place. The third slot 28, on the upper side of handle 14, provides a convenient recess in which to position loop end 40.

The article carrying means of the present invention is both quick and easy to attach to packages and other articles, and can be conveniently adjusted to accommodate articles of different sizes. It securely locks the cord to the handle utilizing the pressure exerted by the weight of the article carried, and does not rely on the strength of hooks or clamps to secure the cord. As such, it can safely be used to lift relatively heavy objects, within the strength limits of the cord. The carrier is relatively simple and inexpensive to manufacture, and both the handle and the cord can be made from a variety of materials. The size of the handle described above, and its material, are intended to be illustrative only, and other variation of the present invention will occurr to those skilled in the art. The carrying means is easily adjustable to accommodate a wide variety of article sizes and shapes. By grasping the handle in one hand, the package-encircling first loop can be shortened by pulling on auxiliary loop 60 with the other hand. Alternatively, first loop 36 can be lengthened by pulling on the end 40 of first loop 36, up to the limit of the length of the cord. No clamps or fasteners are needed to secure the handle to the cord, since the cord self-tightens against the handle when in use. When not in use, the cord can be wrapped around the handle, creating a compact unit which can be carried in a pocket.

What is claimed is:

1. Article carrying means comprising: a handle having an elongated body extending between first and second ends, means forming generally parallel first and second openings through the body of said handle between upper and lower sides thereof and generally parallel first and second slots in said respective first and second ends of said handle, a length of cord extending from said upper side of said handle through said first and second openings and forming a continuous first loop of said cord between said openings on said lower side of said handle, said first loop including first and second legs extending, respectively, from said first and second openings, said first loop being connected together at the end of said first loop to complete the loop, wherein said first loop is used to encircle an article to be carried with both said first and second legs of the loop disposed generally parallel to one another around the article, and an auxiliary loop of said cord for adjusting the length of said first loop, said auxiliary loop extending between said first and second openings on said upper side of said handle and said handle being movable relative to the cord extending through said openings such that, when said auxiliary loop is pulled relative to said handle, cord is drawn through said openings to shorten the length of said first loop on said lower side of said handle thereby facilitating the carrying of articles having a smaller girth, said end of said first loop being secured to said handle for carrying articles encircled by said first loop by hooking said end of said first loop lengthwise over said handle with said first leg engaged in said first slot and said second leg engaged in said second slot.

2. Article carrying means as in claim 1 in which said first said opening is proximate to said first slot near one end of said handle and said second opening is proximate to said second slot near the other end of said handle.

3. Article carrying means as in claim 2 including means forming a third slot in said handle extending lengthwise accross said upper side and communicating with said first and second slots on the ends of said handle.

4. Article carrying means as in claim 1 in which said handle is of a cylindrical shape having a circular cross-section and said means forming said first and second slots in the ends thereof includes substantially straight cuts of a selected depth into the circular ends of said handle.

5. Article carrying means as in claim 1 in which said auxiliary loop includes cord extending from said first opening on said upper side of said handle through said first slot to said lower side of said handle and from said second opening on said upper side of said handle through said second slot to said lower side of said handle such that said auxiliary loop extends between said slots on the lower side of said handle, said first and second slots being sufficiently large to accommodate two cords in each said slot, and wherein said first loop, when hooked over said handle to secure said first loop to said handle, overlies said auxiliary loop in said first and second slots and exerts pressure to prevent slippage of said auxiliary loop in said slots when carrying an article.

6. Article carrying means comprising: a handle having an elongated body extending between two ends, means forming a first slot in one end of said handle and means forming a second slot in the other end of said handle, means forming a first opening extending through the body of said handle proximate to said first slot and means forming a second opening extending through the body of said handle proximate to said second slot, said first and second slots and said first and second openings all being substantially parallel to one another and extending between upper and lower sides of said handle, a length of cord extending through said first and second openings and forming a continuous first loop of said cord extending from said lower side of said handle between said openings, said first loop including first and second legs extending, respectively, from said first and second openings, said legs being connected together at the end of said first loop to form a continuous first loop which is sufficiently long to encircle an article to be carried with both said first and second legs of the loop disposed generally parallel to one another around the article, said first and second legs also extending and being freely movable through said respective first and second openings, emerging on said upper side of said handle as the length regulating portions of said respective first and second legs, said length regulating portion of said first leg extending over said upper side to said first slot and through said first slot to said lower side and said length regulating portion of said second leg extending over said upper side to said second slot and through said second slot to said lower side, the length regulating portions of said first and second legs being coupled together to form an auxiliary loop of said cord which, when pulled relative to said handle, draws cord through said openings to shorten the length of said first loop on said lower side of said handle, and said first loop being secured to said handle by hooking said end of said first loop lengthwise over said handle with each said leg engaged in one slot overlying said length regulating portion of the leg in the slot whereby pressure exerted by said legs of said first loop when carrying an article will secure said length regulating portions of said legs in said slots.

7. Article carrying means as in claim 6 including means forming a third slot in said handle extending lengthwise accross said upper side and communicating with said first and second slots on the ends of said handle.

8. Article carrying means as in claim 6 in which said handle is of a cylindrical shape having a circular cross-section and said means forming said first and second slots in the ends thereof include substantially straight cuts of a selected depth into the circular ends of said handle.

* * * * *